United States Patent [19]

Roth et al.

[11] 4,362,254

[45] Dec. 7, 1982

[54] CLOSURE AND CONTAINER NECK STRUCTURE THEREFOR

[75] Inventors: Donald J. Roth, Westport; Charles S. Kubis, Weston, both of Conn.; John Walter, Evergreen Park, Ill.

[73] Assignee: The Continental Group, Inc., Stamford, Conn.

[21] Appl. No.: 326,956

[22] Filed: Dec. 2, 1981

Related U.S. Application Data

[63] Continuation-in-part of Ser. No. 291,594, Aug. 10, 1981.

[51] Int. Cl.[3] ..... B65D 39/00

[52] U.S. Cl. ..... 220/307; 222/569; 222/570

[58] Field of Search ..... 220/307, 260, 375; 222/543, 569, 570

[56] References Cited

U.S. PATENT DOCUMENTS

| | | | |
|---|---|---|---|
| 2,834,521 | 5/1958 | Nyden | 222/570 X |
| 3,263,724 | 8/1966 | Mojonnier et al. | 220/307 X |
| 4,327,842 | 5/1982 | Walter | 220/307 X |
| 4,328,906 | 5/1982 | Walter | 220/307 |

*Primary Examiner*—George T. Hall
*Attorney, Agent, or Firm*—Charles E. Brown

[57] ABSTRACT

This relates to a neck structure on a domed container end for receiving a thermoplastic material closure. It particularly relates to containers having very thin walls on the order of 6–9 mils and wherein the container is formed of a metal having a grain which generally defines a fold line. In order to avoid undue deformation of the lower part of the usual ring which receives the closure body, the domed end immediately adjacent an encircling ring is provided with an upstanding bead which is shock absorbent and functions resiliently to reinforce the lower part of the ring and to restore it to its original configuration after the body of the closure has been pressed through the ring. Further, the closure is provided with a depending skirt which is circumferentially aligned with the bead and slightly axially spaced therefrom so that when an undue load is placed on the closure, that load may be primarily transmitted, after initial deflection of the neck ring, to the domed end through the closure skirt and the bead. This abstract forms no part of the specification of this application and is not to be construed as limiting the claims of the application.

17 Claims, 4 Drawing Figures

CLOSURE AND CONTAINER NECK STRUCTURE THEREFOR

This application is a continuation-in-part of our copending application Ser. No. 291,594, filed Aug. 10, 1981.

This invention relates in general to new and useful improvements in thin walled metal containers, preferably aluminum containers, having a small diameter neck structure into which there is pressed a plastic closure.

The plastic closure includes a cylindrical body which terminates in a radially enlarged lower part defining an upwardly facing sealing shoulder and wherein the enlarged lower part is tapered to facilitate insertion of the closure into the neck structure.

While such closures may be readily assembled with containers having relatively thick walls, when the thickness of the metal is reduced so as to be on the order of 4–9 mils, it has been found that the neck structure has a tendency to collapse during the forced insertion of the closure body with the result that an improper connection, together with an improper seal, often results.

First of all, it is to be understood that the aluminum metal is rolled stock and thus has a grain along which the aluminum more easily folds. With the very thin metal, when the closure body is forced into the neck structure, there is a tendency for the neck structure to expand more in the grain direction with the resulting folding of the neck structure so as to eliminate the original annular surface with which the closure shoulder is engaged in sealed relation.

This invention particularly relates to the forming of a neck structure for a thin walled metal container wherein the customary closure receiving terminal ring is reinforced by a radially outwardly positioned upstanding bead which functions both to absorb the shock of the required insertion force and also to reinforce the axially inner end of the ring against collapsing or folding while at the same time providing means for returning the lower end of the ring to its original configuration.

The bead also has a further function in that it is disposed radially outwardly of the ring and when the closure is provided with a radially outer depending skirt, and with the bead being radially aligned but suitably axially spaced with the skirt, after the initial foreshortening of the ring due to deflection, loads imposed upon the closure during filling and stacking may be imparted directly to the neck structure through the closure skirt to the bead.

In accordance with the foregoing, it will be apparent that the principal object of this invention is to provide a novel neck assembly for a container which incorporates an upstanding bead surrounding the customary generally cylindrical ring into which a closure is inserted, with that bead serving resiliently to reinforce and maintain the cross section of the portion of the ring which forms a seal with the closure and also serving to limit relative downward movement of the closure with respect to the ring.

With the above and other objects in view that will hereinafter appear, the nature of the invention will be more clearly undetstood by reference to the following detailed description, the appended claims, and the several views illustrated in the accompanying drawings.

IN THE DRAWINGS

Figure 1:
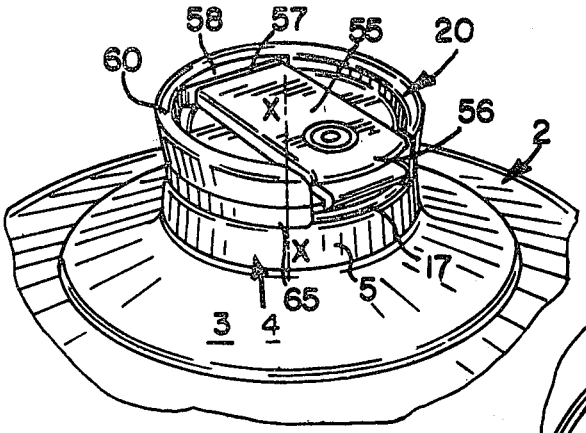
FIG. 1 is a fragmentary top perspective view of a container incorporating the invention.
Figure 2:
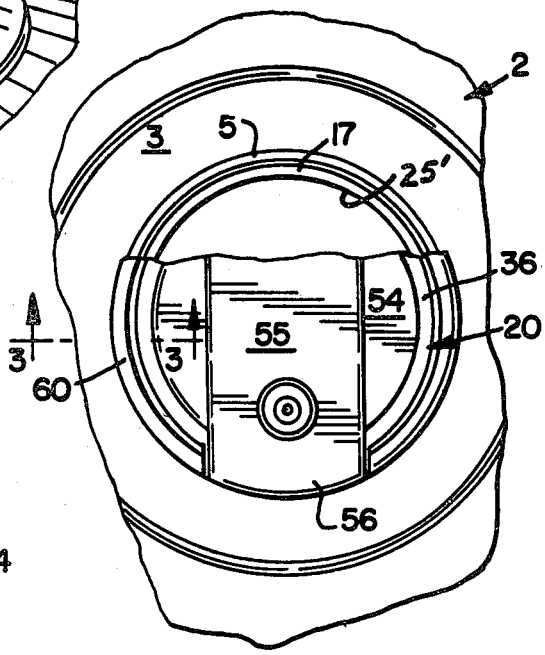
FIG. 2 is a top plan view with a portion of the closure broken away.
Figure 3:
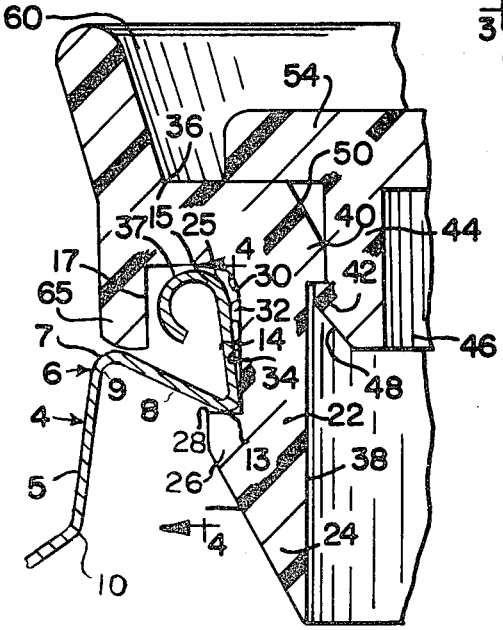
FIG. 3 is an enlarged fragmentary cross section taken substantially on the line 3—3 of FIG. 2.
Figure 4:
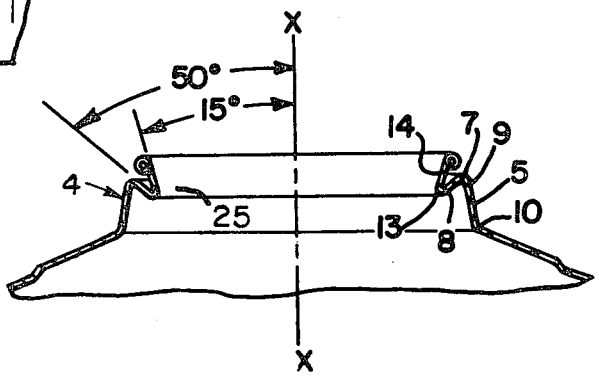
FIG. 4 is a section taken on the line 4—4 of FIG. 3.

Referring now to the drawings in detail, it is to be understood that the invention relates to a metal container particularly adapted for receiving beverages packaged under internal pressures, such beverages being of the class of carbonated beverages, beer and the like. The container may be of a usual construction and is identified by the numeral 2, although only the extreme upper central portion of a domed end 3 thereof is illustrated. The upper circular portion of the domed end 3 is provided with an integral neck structure 4. Normally the neck structure of such a domed end would constitute a cylindrical neck ring or a neck ring which is slightly flared and through which is forced a body of a closure. In accordance with this invention, the neck structure 4 also includes a neck ring 14. However, instead of the neck ring 14 being directly connected to the domed end 3, there is provided intermediate the neck ring or retainer ring 14 and the adjacent portion of the domed end 3 an upstanding annular bead. The bead 6 includes an outer tubular neck element 5 which is frustoconical and which tapers radially inwardly and axially outwardly. The neck element 5 is formed at its upper end with an upwardly convexed outer juncture 7 which is in the form of a broad radius and which merges into an upper end of an inturned frustoconical lip 8 which tapers radially inwardly and axially inwardly. It will thus be seen that the bead 6 is formed by the neck element 5, the outer juncture 7 and the frustoconical lip 8.

The lower end of the lip 8 which terminates intermediate an upper end 9 and a lower end 10 of the neck element 5 is joined by an outwardly opening arcuate lower edge juncture 13 to the lower or inner end of the neck or retainer ring 14. The retainer ring 14 is also of a frustoconical configuration which is disposed radially inwardly of the lip 8 and flared toward its outer or upper end and has an upper portion 15 which projects above the outer juncture 7. The upper portion 15 of the ring 14 terminates in a radially outwardly turned curl 17.

In accordance with a preferred embodiment of the invention, the lip 8 is inclined to the axis X—X of the container 2 at an angle of approximately 50° and the retainer or neck ring 14 is inclined to the axis X—X at an angle of approximately 15°. The neck element 5 converges upwardly toward the axis X—X at an angle of approximately 10°. Thus, through their interconnecting junctures 7 and 13, the neck element 5, the lip 8 and the ring 15, which are arranged in a radially nested relation, there develops a spring assembly.

The domed end 3 carries a closure which is formed of suitable thermoplastic materials such as polypropylene and includes a generally cylindrical body or sleeve 22 having a tapered lower end portion 24. The tapered or wedge-shaped lower end portion 24 of the closure sleeve 22 terminates in an upwardly facing, radially outwardly directed shoulder 26 which provides a ledge or sealing surface 28 disposed normal to the axis X—X.

The external surface 30 of the cylindrical body 22 has formed thereon intermediate its ends a pair of radially outwardly extending, generally triangular cross-sectional sealing rings 32, 34 which are spaced axially of the body 22.

Without going into other details of the closure 20 at this time, it is to be understood that when the ring 14 is connected directly to the domed end 3 and with the absence of the rib 6, when the wedge-shaped lower end portion 24 of the closure sleeve or body 22 is forced through the opening defined by the ring 14, while there is a certain radial inward deflection of the wedge-shaped lower edge portion 24 so as to permit passage thereof through the ring 14, because of the extreme thinness of the metal from which the domed end 3 is formed, there is a certain deflection of the metal of the domed end, particularly at the intersection of the ring 14 with the domed end. This expansion of the very thin metal, particularly when the metal is aluminum, and wherein the aluminum is formed with the customary grain, instead of the lower end of the ring 14 maintaining its circular cross section, the metal has a tendency to fold along the grain and thus provide an oval-shaped configuration at the lower end of the ring 14.

After the wedge-shaped lower edge portion 24 of the closure 20 passes entirely through the ring 14, there is insufficient resiliency in the ring 14 again to assume its circular configuration. Further, there is insufficient resiliency, particularly in view of the fold of the metal, for the lower end of the ring 14 to lie in a plane as is necessary to provide a seal between the lower end of the ring 14 and the shoulder or sealing surface 28. Thus, a leak passage is initiated with the prior art neck construction.

In accordance with this invention, by providing the upstanding bead 6 immediately adjacent the ring and by connecting the bead lip 8 to the lower end of the ring 14 by the juncture 14, it will be seen that the lower portion of the ring 14 is first of all reinforced against unequal outwardly directed expansion and also against the customary folding. Further, because of the inherent characteristics of a bead, the bead 6 serves resiliently to urge the lower end of the ring 14 in a uniform manner back to its original configuration. Thus, the juncture 13, which is relatively blunt, ends up seated within the corner defined by the surface 28 and the cylindrical outer wall of the sleeve or body 22 and a good seal is effected.

Further, although the ring 14 is of a frustoconical configuration and tapers toward its lower end so as to facilitate the insertion of the body 22 thereinto, it will be seen that the seals 32, 34 are of different sizes and serve tightly to engage the inner surface 25 of the ring 14 in sealed relation.

The upper end of the closure body 22 has a peripheral flange 36 integrally formed with the body 22. The undersurface of the flange is positioned adjacent the upper surface of the curl 17 but is normally very closely spaced therefrom. It is to be understood that the internal pressure within the container 2 will serve to force the closure 20 outwardly at a sufficient pressure to provide for the necessary sealing of the closure relative to the container when there is a good seal between the juncture 13 and the shoulder 28.

The body 22 has a bore 38 which provides a pour opening for the container 2. At the upper end of the bore 38 there is provided an inwardly extending annular shoulder 40 which is engaged by a radially outwardly extending shoulder 42 on the lower part of a cylindrical body 44 of a plug 46. The body lower part is provided with a tapered outer surface 48 at its lower end to facilitate insertion of the plug 48 through the bore 38. In order further to facilitate the insertion of the plug 46 through the bore 38, the body is provided at the upper end of the bore 38 with a frustoconical guide surface 50.

The upper end of the plug 46 has a top wall 54 which peripherally extends over the flange 36 and bears thereagainst. The plug 46 is provided with a lever 55 which, when lifted at the end 56, fulcrums at 57 against a fulcrum 58 formed as part of an upstanding lip 60 about the periphery of the flange 36. Lifting of the lever opens the plug and this operation is more fully set forth in U.S. application Ser. No. 209,556, filed Nov. 24, 1980 in the name of John Walter and is commonly assigned with this application.

In accordance with this invention, there is also formed about the periphery of the flange 36 a depending skirt 65. It is to be noted that the skirt 65, in conjunction with the underside of the flange 36 and the upper portion of the body 22, define an annular channel in which the curl 17 is located. It is also to be noted that the skirt 65 is radially aligned with the bead 6 and is axially spaced from the juncture 7 a limited distance.

Normally, the skirt 65 has no function. However, it is to be understood that when the container 10 is filled, a filling head engages the closure body 22 under considerable loading which forces the closure 20 down relative to the neck construction and serves to deform the neck construction. While the ring 14 is free to deform downwardly with the curl 17 moving radially outwardly a short amount, after a very slight deflection and effective foreshortening of the ring 14, the skirt 65 engages the bead 6 and directly transmits the loading on the closure 20 and from the closure 20 to the domed end 3.

It is also to be understood that when the filled containers are packaged and the packages are stacked, there is a relatively high stacking load imposed upon the closure which, after it becomes too high, may be transmitted to the domed end 3 through the skirt 65.

In the past it has been found that by heating the body of the closure 20 on the order of two minutes, this has increased the softness of the thermoplastic material and permits the body considerably to deform as it is forced into the neck ring. It has been found that by increasing this heating time, other conditions remaining unchanged, from two minutes to five minutes, assembly of the closure with the container end has been greatly facilitated.

Although only a preferred embodiment of the neck construction has been specifically illustrated and described herein, it is to be understood that minor variations may be made in the neck construction without departing from the spirit and scope of the invention as defined by the appended claims.

We claim:

1. A neck and closure assembly for a container wherein said neck comprises:

a tubular neck member integrally formed with a portion of a container and extending axially from the remainder of the container for receiving a closure, said neck member including a radially and axially inturned lip, a retainer ring carried by said lip extending axially of the container, said closure comprising a tubular element mounted within said ring and having means in fluid-tight engagement with said tubular neck member.

2. The invention according to claim 1 wherein said lip is generally frustoconical and tapers toward the interior of the container.

3. The invention according to claim 1 wherein said ring is generally axially coextensive with said lip.

4. The invention according to claim 1 wherein said closure is formed of plastic material and said ring and lip have inner ends joined by a rounded portion defining a dull non-cutting edge, and a shoulder on said tubular element of the closure being in a sealing engagement with said non-cutting edge.

5. The invention according to claim 1 wherein said ring has an axially outer end with a reinforcing curl providing a blunt surface, and another shoulder on said tubular element of said closure opposing said surface of said curl.

6. The invention according to claim 1 wherein said lip and said ring are in closely nested relation and both are frustoconical.

7. A container neck for receiving a closure assembly, said container neck comprising a container member terminating in a container neck and a closure seated in said container neck in sealed relation, said container neck including a ring and an upstanding bead radially surrounding said ring and directly connected to said ring in a blunt axially inner juncture to form shock absorbing and reinforcing means controlling expansion of said ring and said blunt juncture during the application of a closure.

8. A container neck in accordance with claim 7 wherein said bead includes an outer generally upstanding tubular neck element joined to a radially and axially inwardly sloping lip by an axially outer convex juncture.

9. A container neck in accordance with claim 8 together with a closure seated in said container neck, said closure including a cylindrical body extending axially through said ring and having an axially upwardly facing shoulder engaging said blunt axially inner juncture, said closure also having an outer depending skirt radially surrounding an upper part of said ring and being in generally radially aligned and axially spaced relation to said axially outer convex juncture for applying compressive loadings directly to said container neck through said bead.

10. A container neck in accordance with claim 7 together with a closure seated in said container neck, said closure including a cylindrical body extending axially through said ring and having an axially upwardly facing shoulder engaging said blunt axially inner juncture.

11. A neck structure for a container comprising a tubular neck member having a radially and axially inturned lip terminating in an inner edge, and an integral closure-supporting retaining ring connected to said inner edge and extending axially outwardly therefrom.

12. The invention according to claim 11 wherein said element, lip and ring are disposed in nested relation and said ring has a blunt seating edge portion disposed axially outwardly of the juncture of said ring and said lip.

13. The invention according to claim 12 wherein said lip and ring are both frustoconical.

14. The invention according to claim 11 wherein said lip and said ring define a cantilevered shock-absorbing resilient structure adapted for impact application, without collapsing, of a closure element thereto.

15. A method of assembling a closure of heat softenable plastic material having a sleeve portion with a neck structure of a thin wall metal container, said method comprising the steps of forming said neck structure with a plurality of interconnected nested elements in a load buffering assembly, heating said closure to soften the material of the closure, then forcibly axially impacting said sleeve portion into the innermost one of the nested elements in sealing engagement therewith, then cooling said closure to ambient temperature.

16. The invention according to claim 15 wherein said neck structure includes an outer element, an intermediate element and said innermost element.

17. A three element crush resistant thin wall metal container neck structure comprising a radially outer tubular element, a radially intermediate tubular element and a radially inner tubular element, said elements being in radially adjacent relation, said outer and intermediate elements having a radially outer edge connecting juncture and said intermediate and inner elements having a radially inner edge connecting juncture, said elements being arranged in a manner for buffering predetermined loads imposed thereon.

* * * * *